US008294013B2

(12) United States Patent
Lento

(10) Patent No.: US 8,294,013 B2
(45) Date of Patent: Oct. 23, 2012

(54) PERCUSSION RESONANCE SYSTEM

(76) Inventor: James A. Lento, Eastchester, NY (US)

( * ) Notice: Subject to any disclaimer, the term of this patent is extended or adjusted under 35 U.S.C. 154(b) by 0 days.

(21) Appl. No.: 13/033,540

(22) Filed: Feb. 23, 2011

(65) Prior Publication Data

US 2011/0138988 A1 Jun. 16, 2011

Related U.S. Application Data

(63) Continuation of application No. 12/318,908, filed on Jan. 12, 2009, now abandoned.

(51) Int. Cl.
*G10D 13/02* (2006.01)

(52) U.S. Cl. ..... 84/411 R

(58) Field of Classification Search ..... 84/411 R, 84/414

See application file for complete search history.

(56) References Cited

U.S. PATENT DOCUMENTS 494,485 A * 3/1893 Nightingale ..... 84/294
529,514 A * 11/1894 Andres ..... 84/272
585,003 A * 6/1897 Noble ..... 84/170
636,848 A * 11/1899 Richards ..... 84/414
818,289 A * 4/1906 Randall ..... 84/294
1,420,233 A * 6/1922 Baldwin et al. ..... 84/411 R
2,042,080 A * 5/1936 Turner ..... 84/296
3,102,510 A * 9/1963 Hershey et al. ..... 116/148
4,124,092 A * 11/1978 Kajiya et al. ..... 181/265
4,134,324 A * 1/1979 LeMert ..... 84/411 R
4,170,162 A * 10/1979 Casavant ..... 84/453
4,356,757 A * 11/1982 Mooy ..... 84/411 R
4,805,514 A * 2/1989 Billings ..... 84/411 M
5,095,796 A * 3/1992 Genna ..... 84/414
5,159,139 A 10/1992 Beals et al.
5,237,903 A * 8/1993 Bein et al. ..... 84/404
5,361,669 A * 11/1994 Genna ..... 84/414
5,864,077 A 1/1999 Gatzen
5,986,196 A 11/1999 Behrenfeld
6,072,111 A * 6/2000 Senn ..... 84/402
6,172,289 B1 * 1/2001 Shelley ..... 84/411 R
6,245,979 B1 * 6/2001 Campbell ..... 84/411 R
6,700,044 B1 * 3/2004 Bencomo, Jr. ..... 84/411 R
6,784,352 B2 8/2004 Suenaga
6,810,531 B1 11/2004 Lento
6,927,330 B2 * 8/2005 May ..... 84/411 R
6,949,701 B2 9/2005 Okumura
7,148,413 B2 * 12/2006 May ..... 84/411 R
7,259,308 B2 * 8/2007 Geiger ..... 84/294
7,470,846 B2 * 12/2008 May ..... 84/411 R
7,485,789 B2 * 2/2009 Gasull, III ..... 84/411 R
7,498,500 B2 * 3/2009 Rogers ..... 84/411 P
7,560,632 B1 * 7/2009 Lanzel et al. ..... 84/411 R (Continued)

*Primary Examiner* — David Warren
*Assistant Examiner* — Robert W Horn
(74) *Attorney, Agent, or Firm* — Richard C. Litman

(57) ABSTRACT

The percussion resonance system allows a drummer to produce additional, resonant acoustic effects beyond those produced by a conventional drum or other percussion instrument. In one embodiment, the percussion resonance system includes a substantially cylindrical sidewall having opposed upper and lower open ends, similar to the sidewall of a conventional drum, and batter and resonant heads respectively covering the upper and lower ends of the substantially cylindrical sidewall. A plurality of apertures are formed through either the batter head, the resonant head, or both, in order to produce additional acoustic effects caused by the air passing through the apertures as the heads vibrate. Air passing through the apertures increases the overall tonal qualities of the percussion instrument, and further aids in decreasing generation of unwanted vibrations, particularly in the form of ringing sounds or overtones. Further embodiments include inserts for percussion instruments having surfaces with similar apertures formed therethrough.

14 Claims, 21 Drawing Sheets

U.S. PATENT DOCUMENTS

| | | | | |
|---|---|---|---|---|
| 7,582,820 | B2 * | 9/2009 | Millender et al. | 84/411 R |
| 7,659,469 | B2 * | 2/2010 | Belli | 84/411 R |
| 7,777,109 | B2 * | 8/2010 | Saragosa | 84/302 |
| 7,785,169 | B2 * | 8/2010 | Moss | 446/418 |
| 7,928,303 | B2 * | 4/2011 | Millender et al. | 84/411 R |
| 7,968,780 | B2 * | 6/2011 | Millender et al. | 84/411 R |
| 2003/0070533 | A1 | 4/2003 | Ezbicki | |
| 2006/0021495 | A1 | 2/2006 | Freitas | |
| 2007/0022863 | A1 | 2/2007 | Ross | |
| 2007/0157793 | A1 | 7/2007 | Ischer | |
| 2007/0163423 | A1 | 7/2007 | Rogers | |
| 2008/0078279 | A1 * | 4/2008 | Belli | 84/411 R |
| 2009/0019985 | A1 * | 1/2009 | Casanta | 84/411 R |
| 2009/0100984 | A1 * | 4/2009 | Ruffino | 84/414 |
| 2010/0083812 | A1 * | 4/2010 | Peavey | 84/411 R |
| 2010/0107853 | A1 * | 5/2010 | Bausch, III | 84/411 R |
| 2010/0175535 | A1 * | 7/2010 | Lento | 84/414 |
| 2011/0138988 | A1 * | 6/2011 | Lento | 84/414 |
| 2011/0167982 | A1 * | 7/2011 | Schmidt | 84/411 R |

* cited by examiner

PERCUSSION RESONANCE SYSTEM

CROSS-REFERENCE TO RELATED APPLICATION

This application is a Continuation of U.S. patent application Ser. No. 12/318,908, filed Jan. 12, 2009 now abandoned.

BACKGROUND OF THE INVENTION

1. Field of the Invention

The present invention relates to percussion instruments and supplementary devices for percussion instruments to enhance the acoustic effects generated thereby.

2. Description of the Related Art

FIG. 2 illustrates a conventional drum. As shown in FIG. 2, a typical drum D includes a cylindrical shell or sidewall W having upper and lower ends. The upper end is covered by a batter skin or head B (i.e., a membrane stretched across the upper end which the drummer strikes with a drumstick or the like), and the lower end is covered by a similar membrane referred to as a "resonant head" R. The batter head B and resonant head R are secured by tension rods T, which allow the user to adjust the tension in each membrane. The membranes are typically formed from Mylar®, polyester, calfskin or the like.

FIG. 2 illustrates a simple, exemplary drum. Other types of conventional drums include bass drums, snare drums, military drums, floor toms and the like. Further, in recent years, practice drums and percussion instruments also rely on standard membranes. In use, a column of air is defined inside the shell or sidewall, and serves as a vibration propagating medium. The shell is expected to exhibit good vibrational characteristics, as well as the geometric stability. The dimensions of the shell are influential on the column of air and sound propagation therein, thus a specific sound is generated through the column of air. Thus, the geometry and vibrational (or sound) characteristics of the drum are influential on the sound quality, and, accordingly, is one of the substantial properties of the drum. Particularly, how the air (i.e., the acoustic wave-propagating media) is able to travel in and around the drum effects the tonal qualities of the drum. Conventional drums, however, do not provide much variation in their geometric and airflow properties, beyond being able to adjust the tension in the batter and resonant heads.

Thus, a percussion resonance system solving the aforementioned problems is desired.

SUMMARY OF THE INVENTION

The percussion resonance system allows a drummer to produce additional, resonant acoustic effects beyond those produced by a conventional drum or other percussion instrument. In a first embodiment, the percussion resonance system includes a substantially cylindrical sidewall having opposed upper and lower open ends, similar to the sidewall of a conventional drum, and batter and resonant heads respectively covering the upper and lower ends of the substantially cylindrical sidewall. A plurality of apertures are formed through the batter head, the resonant head or both in order to produce additional acoustic effects caused by the air passing through the apertures as the heads vibrate.

Additionally, a plurality of hollow resonance structures may further be provided, with each hollow resonance structure having an open upper end secured to a lower surface of the batter head, adjacent and covering a respective one of the plurality of apertures. Preferably, each structure also has an open lower end. Alternatively, if the apertures are formed through the resonant head (or if a secondary set of apertures are also formed through the resonant head), the plurality of hollow resonance structures each an open lower end secured to an upper surface of the resonant head, adjacent and covering a respective one of the plurality of secondary apertures. Alternatively, each hollow resonance structure may have both an open lower end and an open upper end, with each hollow resonance structure being received within, and passing through, a respective one of the plurality of secondary apertures of the resonant head.

Alternatively, a secondary drum head (a secondary batter head, a secondary resonant head or both) may be provided for covering the conventional drum head, thus producing a thin resonance chamber therebetween. The secondary drum head has a plurality of apertures formed therethrough, as in the above embodiment.

In a further alternative embodiment, the percussion resonance system is an insert for a percussion instrument. The insert includes a substantially cylindrical sidewall defining an open upper end, and a lower wall. The lower wall has a plurality of apertures formed therethrough, and the insert is sized and contoured to be received within the percussion instrument and be positioned beneath an open upper end thereof. Particularly, the sidewall of the insert is dimensioned to contact the inner surface of the percussion instrument's sidewall.

Preferably, the insert has an annular lip formed about the upper end of the substantially cylindrical sidewall, with the annular lip being adapted for positioning on the upper end of the percussion instrument. The batter head of the percussion instrument can then be mounted on the top surface of the annular lip in a conventional manner, or the insert may be provided with a batter head already secured to the lip. As a further alternative, a secondary wall may be positioned substantially parallel to the lower wall, with the secondary wall being positioned between the lower wall and the open upper end and having a plurality of secondary apertures formed therethrough.

In a further alternative embodiment, the percussion resonance system includes a substantially cylindrical sidewall having opposed upper and lower open ends, as in the above, with a batter head covering the upper end of the substantially cylindrical sidewall, and a resonant head covering the lower end of the substantially cylindrical sidewall. At least one resonating member is secured to the substantially cylindrical sidewall, with the at least one resonating member having opposed open and closed ends and at least one sidewall. A plurality of apertures are formed through the closed end thereof.

The substantially cylindrical sidewall of the percussion instrument preferably has at least one opening formed therethrough, with the open end of the at least one resonating member being mounted about and covering the at least one opening. The at least one resonating member may be secured to an inner surface of the substantially cylindrical sidewall or to an outer surface thereof. If secured to the outer surface, the at least one resonating member preferably further includes a cover rotatably secured to the closed end thereof. The cover has a plurality of apertures formed therethrough corresponding to the plurality of apertures formed through the closed end, such that the user may selectively rotate the cover to selectively cover the plurality of apertures formed through the closed end. Preferably, the at least one sidewall of the at least one resonating member has a substantially cylindrical contour.

In a further alternative embodiment, the percussion resonance system includes a substantially cylindrical sidewall having opposed upper and lower open ends, a batter head covering the upper end of the substantially cylindrical sidewall, and a resonant head covering the lower end of the substantially cylindrical sidewall, as in a conventional percussion instrument. The percussion resonance system further includes at least one resonating member secured to an inner surface of the substantially cylindrical sidewall, with the at least one resonating member having at least one sidewall, with a plurality of apertures being formed through the at least one sidewall. The resonating member may be in the form of a plate, at least partially extending across the interior of the drum wall, or may be in the form of a hollow cylinder, extending across the interior of the drum.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
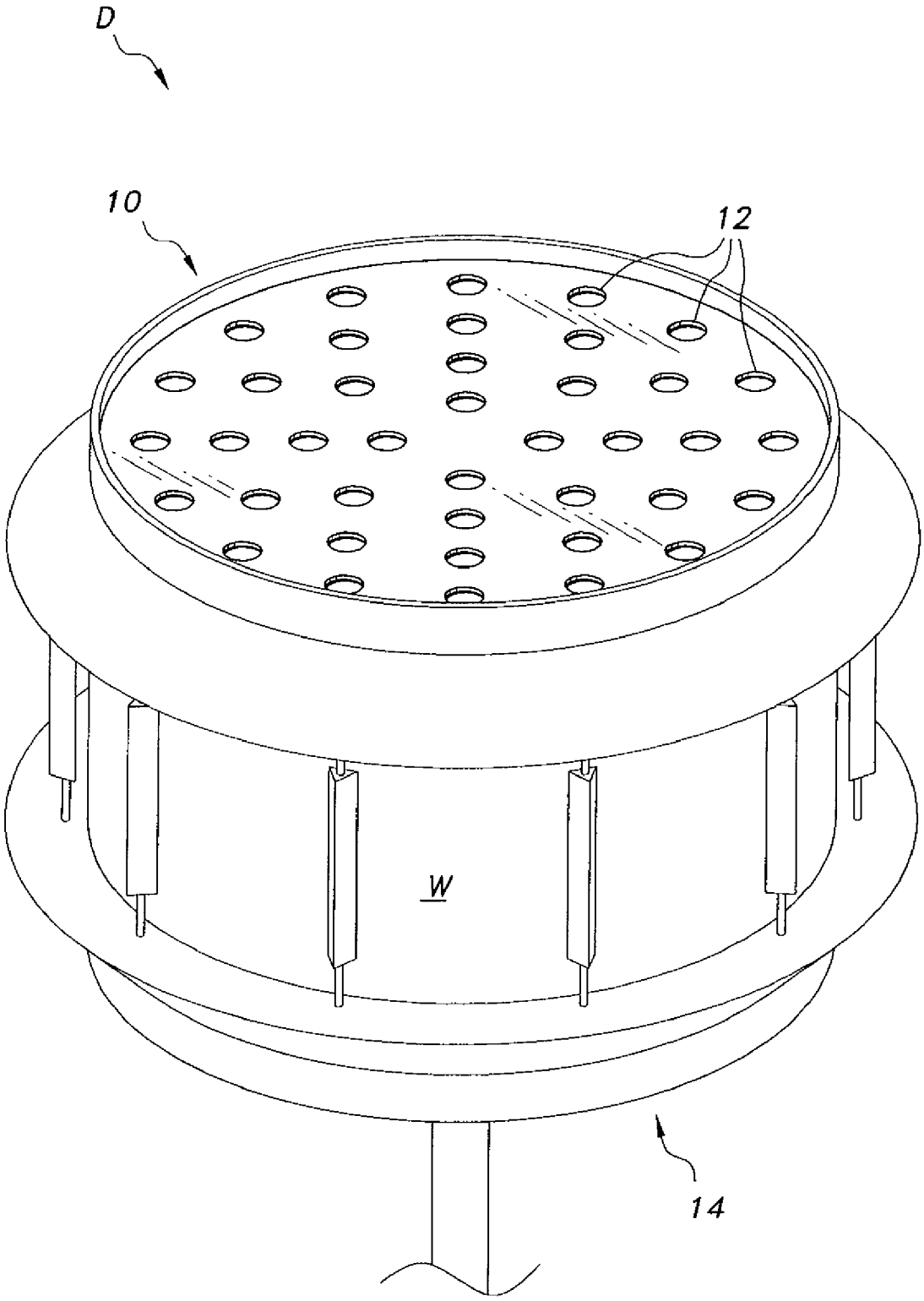
FIG. 1 is a perspective view of a percussion resonance system according to the present invention.
Figure 2:
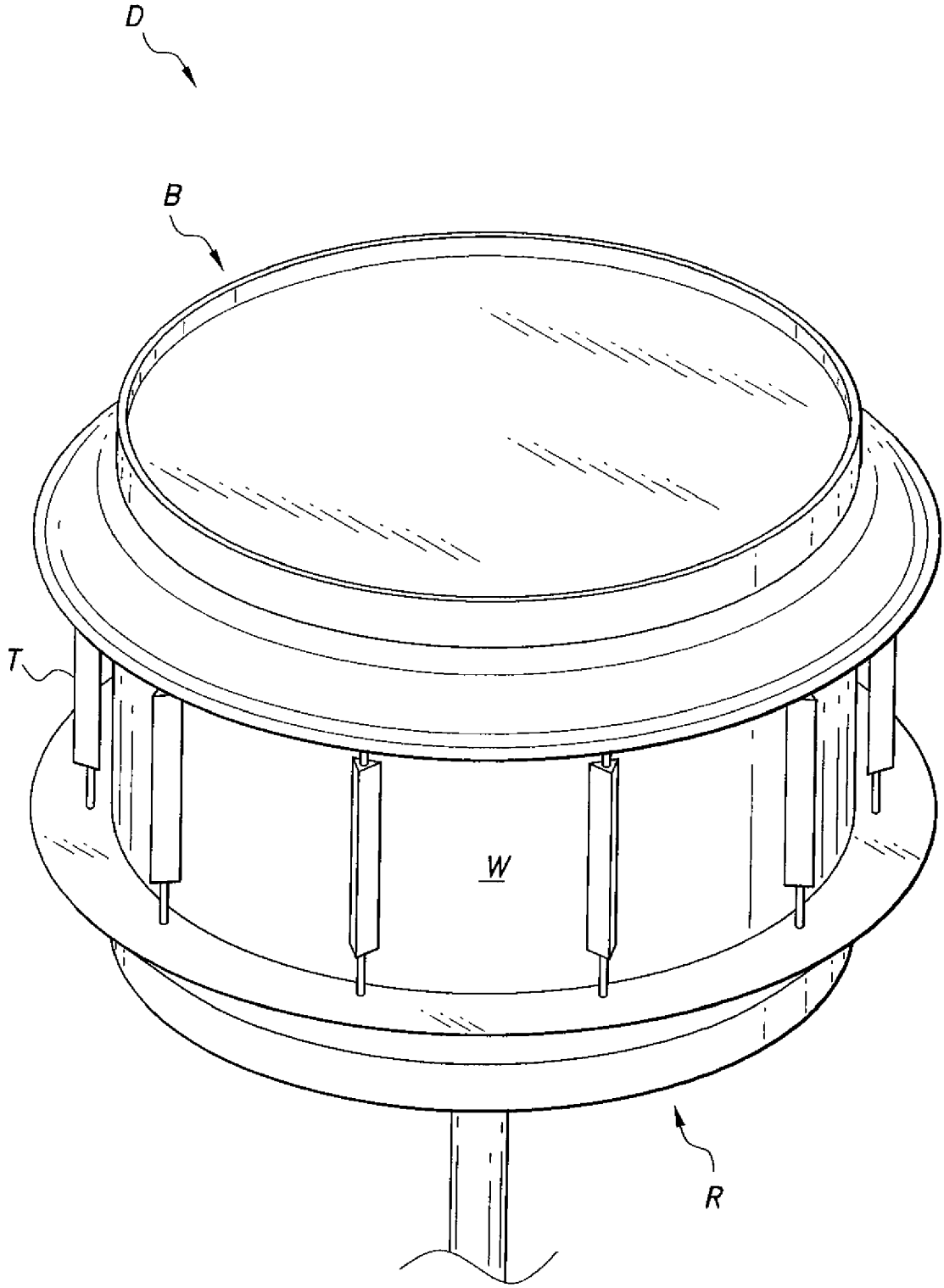
Fig. 2 PRIOR ART
FIG. 2 is a perspective view of a conventional prior art drum.

FIG. 1 illustrates a first embodiment of the percussion resonance system. The percussion resonance system 10 allows a drummer to produce additional, resonant acoustic effects beyond those produced by a conventional drum or other percussion instrument (such as the prior art drum discussed above with regard to FIG. 2). In the embodiment of FIG. 1, the percussion resonance system is in the form of a drum D, which includes a substantially cylindrical sidewall W having opposed upper and lower open ends, similar to the sidewall of the conventional drum of FIG. 2, and batter and resonant heads 10, 14, respectively covering the upper and lower ends of the substantially cylindrical sidewall W. It should be understood that the percussion instrument may take the form of a bass drum, a snare drum, a tambourine, a tom-tom, a bongo drum or any other type of percussion instrument without departing from the spirit or scope of the present invention. Similarly, the various embodiments to be described in detail below may be applied to any sort of musical instrument that includes a resonating surface, such as a banjo, for example. The sidewall or shell W may be formed from wood or any other suitable material, and the batter and resonant heads B, R may also be formed from any suitable material, such as Mylar® or the like.

Figure 3:
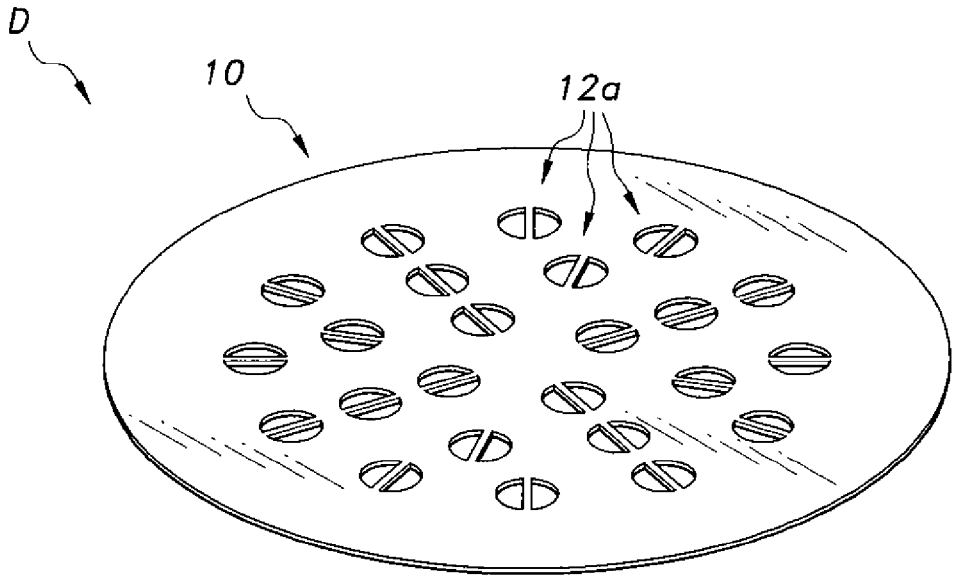
FIG. 3 is a perspective view of an alternative embodiment of a batter head of the percussion resonance system of FIG. 1.
Figure 4:
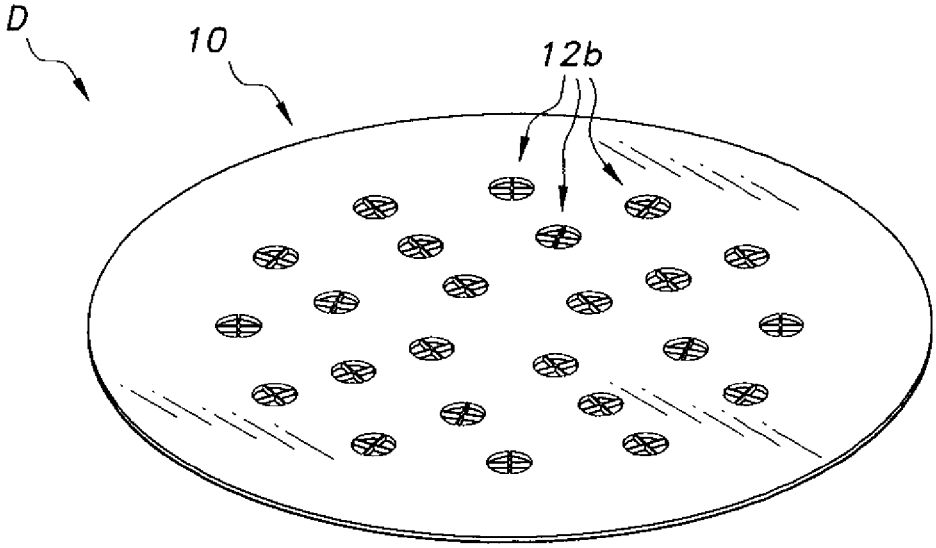
FIG. 4 is a perspective view of an alternative embodiment of a batter head of the percussion resonance system of FIG. 1.

As shown in FIG. 1, a plurality of apertures 12 are formed through either the batter head 10, the resonant head 14, or both, in order to produce additional acoustic effects caused by the air passing through the apertures 12 as the heads vibrate. It should be understood that the size and formation of the apertures 12 are shown for exemplary purposes only. Any desired number of apertures 12 may be formed through the heads, and the apertures 12 may have any desired size or contour. FIGS. 3 and 4 illustrate exemplary alternative shapes for apertures 12*a*, 12*b*, respectively. Relatively large apertures may be formed, for example, or pin-sized apertures may be formed through the heads. Air passing through the apertures increases the overall tonal qualities of the drum D, and further aids in decreasing generation of unwanted vibrations, particularly in the form of ringing sounds or overtones while enhancing the true resonance of the percussion instrument without muffling the sound, yet enhancing the tones. It should be understood that the apertures shown in the Figures are exaggerated for illustrative purposes only. Preferably, the apertures have relatively small diameters so as not to interfere with the head of the drumstick.

Figure 19:
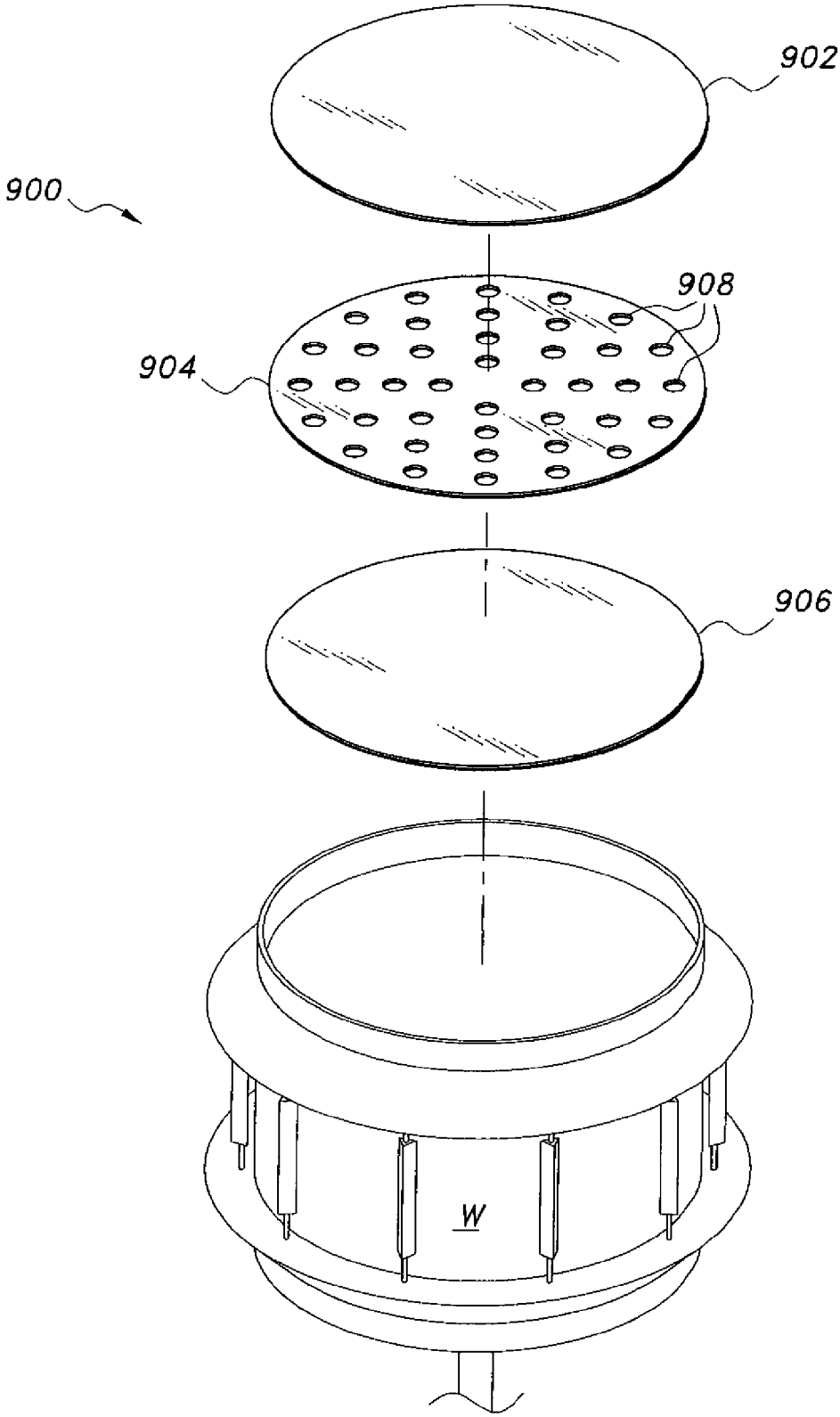
FIG. 19 is a perspective, exploded view of yet another alternative embodiment of the percussion resonance system according to the present invention.

In the alternative embodiment 900 of FIG. 19, the percussion instrument is shown as having a pair of solid heads 902, 906, with a third head or membrane 904 positioned therebetween. Heads 902, 906 are solid and formed substantially similar to conventional batter heads. Head or member 904 is formed similarly to head 10 of FIG. 1, having apertures 908 formed therebetween. Head 902 rests on top of the open end of the instrument, similar to that shown in the prior art of FIG. 2, and heads 904, 906 are received within the cylindrical wall W. It should be understood that head 904 may be spaced apart from head 902 by any desired distance, from zero distance (i.e., contacting head 902) to a user-defined separation.

Figure 9:
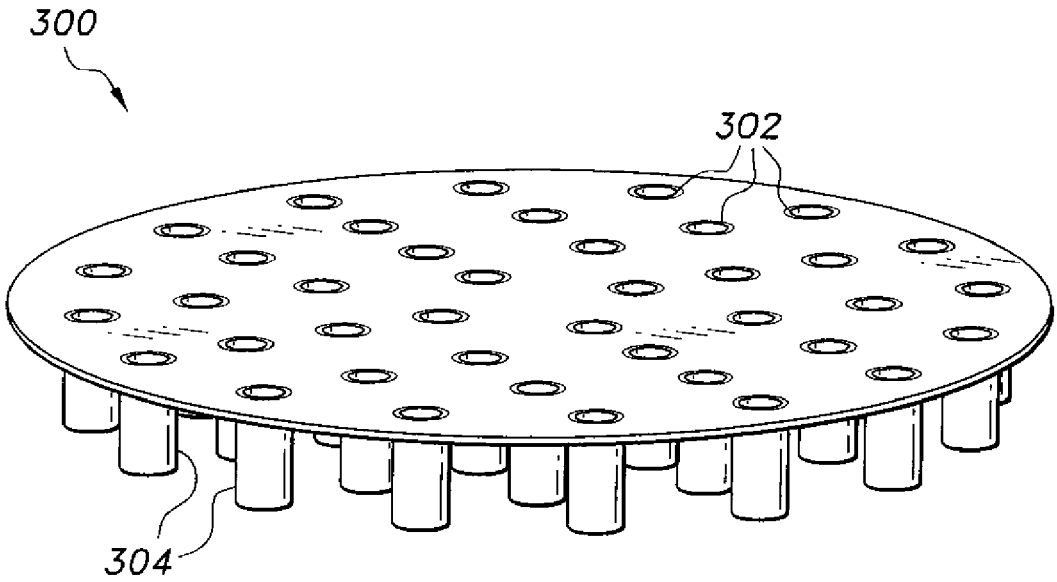
FIG. 9 is a perspective view of the batter head of an alternative embodiment of the percussion resonance system of FIG. 1.
Figure 10:
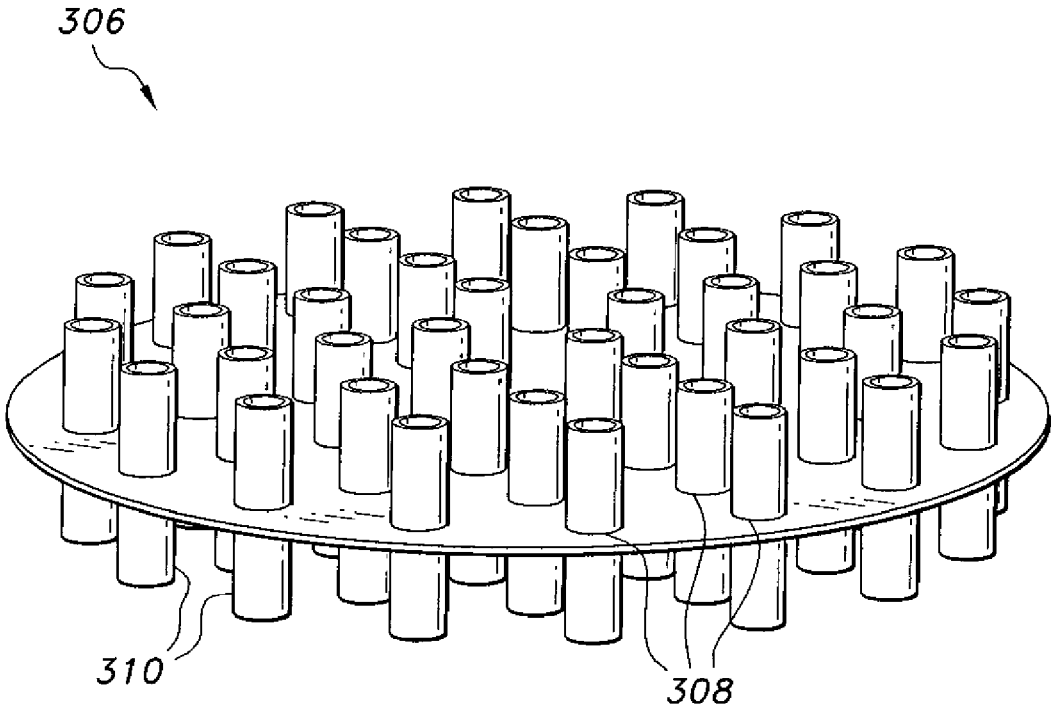
FIG. 10 is a perspective view of a resonant head of an alternative embodiment of the percussion resonance system of FIG. 1.

Additionally, as shown in FIG. 9, a plurality of hollow resonance structures 304 may further be provided, with each hollow resonance structure 304 having an open upper end secured to a lower surface of the batter head 300, adjacent and covering a respective one of the plurality of apertures 302. Preferably, each structure also has an open lower end. Alternatively, if the apertures are formed through the resonant head (or if a secondary set of apertures are also formed through the resonant head in addition to those formed through the batter head), the plurality of hollow resonance structures each has an open lower end secured to an upper surface of the resonant head, adjacent and covering a respective one of the plurality of secondary apertures. Alternatively, as shown in FIG. 10, each hollow resonance structure 310 may have both an open lower end and an open upper end, with each hollow resonance structure 310 being received within, and passing through, a respective one of the plurality of secondary apertures 308 of the resonant head 306. Each hollow resonance structure may have any desired contouring or size and it should be understood that structures 304, 310 are shown for exemplary purposes only.

Figure 17:
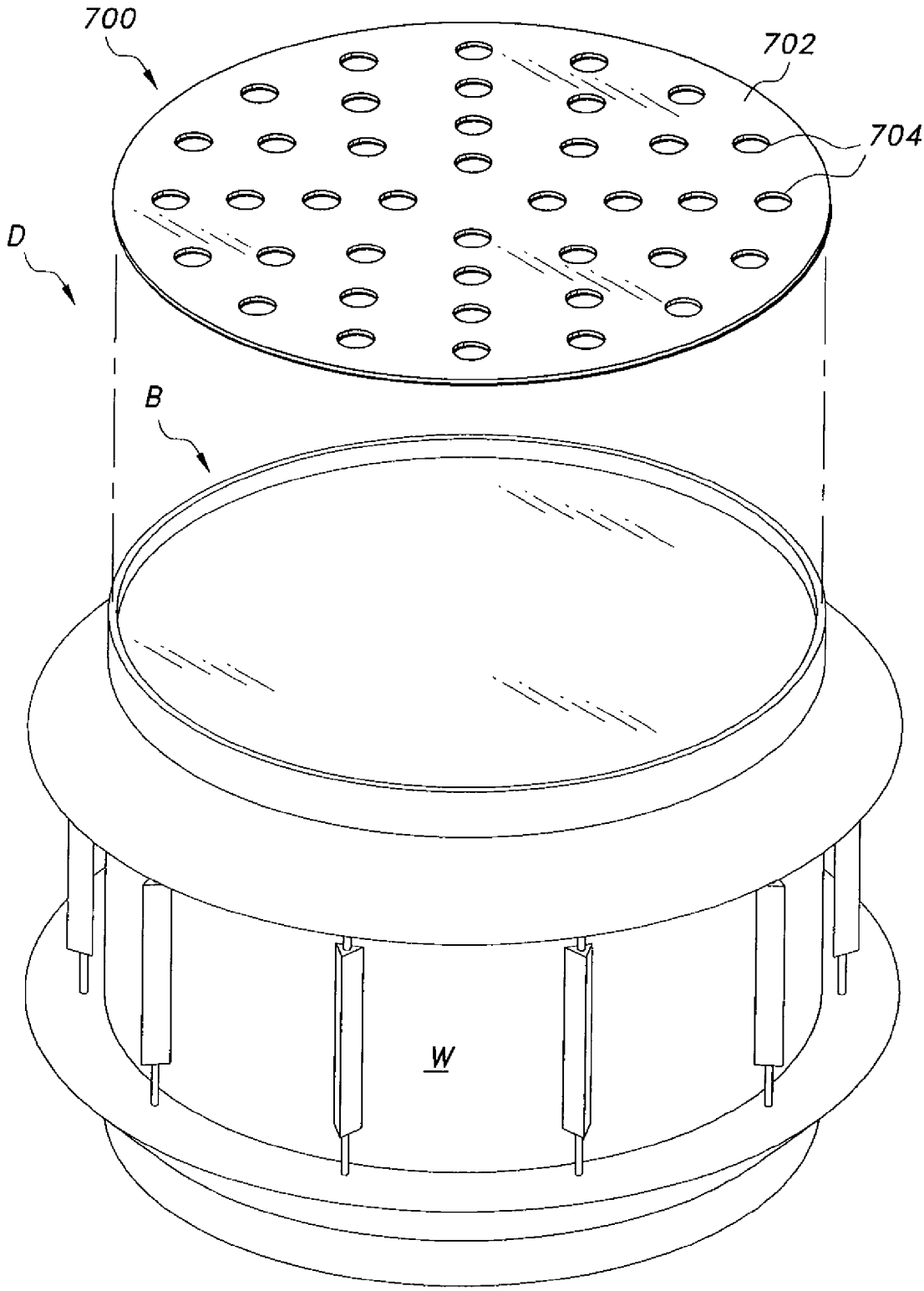
FIG. 17 is an environmental, perspective view of another alternative embodiment of the percussion resonance system according to the present invention.

Alternatively, the system 700 shown in FIG. 17 includes a secondary drum head 702 (a secondary batter head, a secondary resonant head or both) provided for covering the conventional drum head B, thus producing a thin resonance chamber therebetween. The secondary drum head 702 has a plurality of apertures 704 formed therethrough, as in the embodiment of FIG. 1. Alternatively, the secondary head may be positioned within the drum, adjacent the batter head B or the resonant head R, at any desired distance therefrom.

Batter heads are typically formed from either a single sheet of material (typically referred to as a "single ply batter head") or from double sheets of material (typically referred to as "double ply batter heads"). In the above, a double ply batter head may be provided, with one head being formed conventionally, and with the second head being formed with apertures formed therethrough. It should be understood that the perforated batter head may be spaced apart from the solid batter head, or may be placed contiguous to the solid batter head, with no separation therebetween, dependent upon the particular acoustic effects desired by the user.

Figure 5:
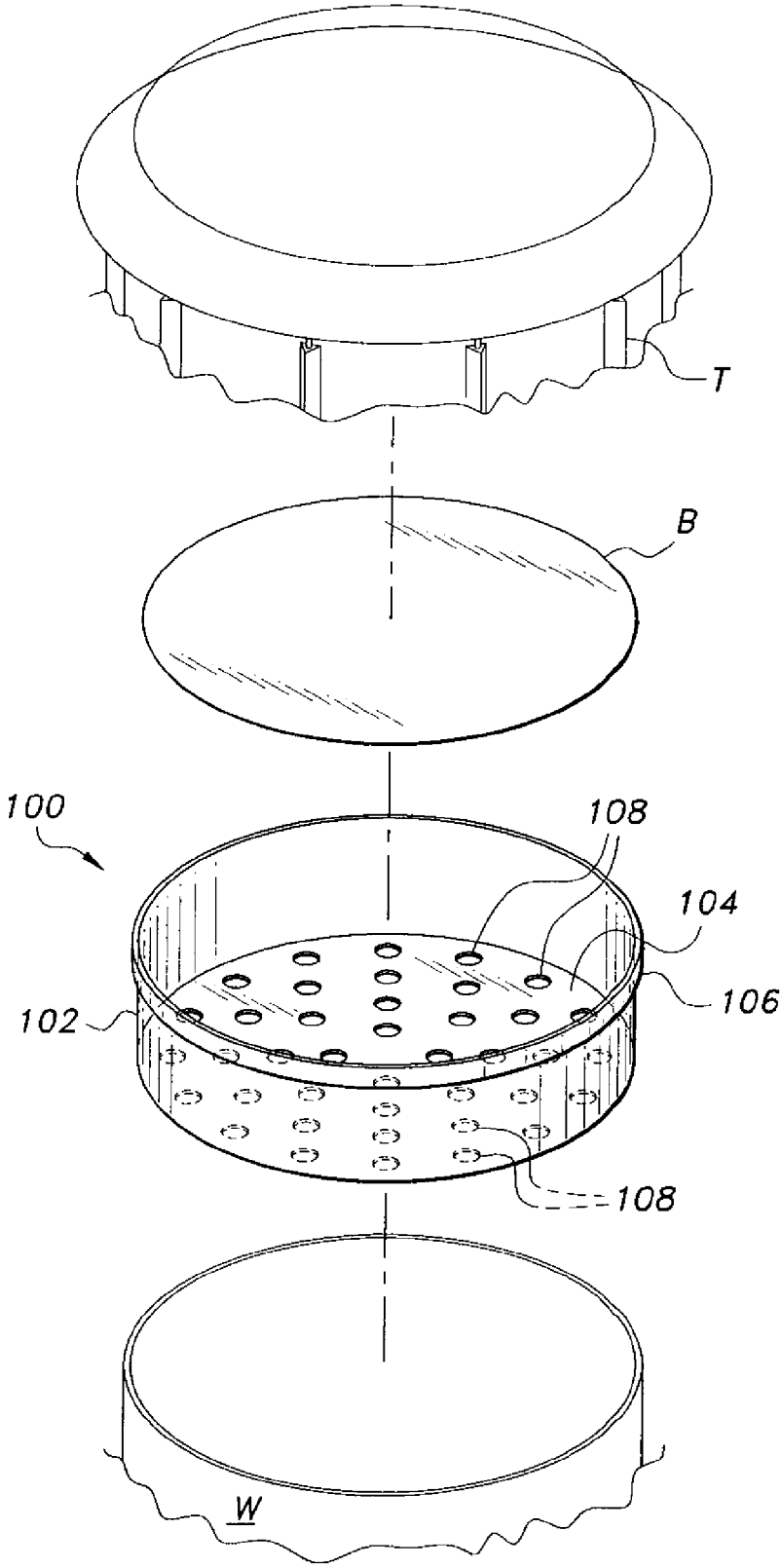
FIG. 5 is an environmental, perspective view of an alternative embodiment of the percussion resonance system according to the present invention.

In a further alternative embodiment illustrated in FIG. 5, the percussion resonance system 100 is in the form of an insert for the percussion instrument. The insert 100 includes a substantially cylindrical sidewall 102 defining an open upper end, and a lower wall 104. The lower wall 104 has a plurality of apertures 108 formed therethrough, and the insert is sized and contoured to be received within the percussion instrument and be positioned beneath an open upper end thereof. Particularly, the sidewall 102 of the insert 100 is dimensioned to contact the inner surface of the percussion instrument's sidewall W. The height of sidewall 102 may be varied, dependent upon the particular tonal qualities desired by the drummer. As shown, sidewall 102 is preferably formed as a solid member, though, as will be described in greater detail below, as a further alternative, apertures may be formed through the sidewall as well.

Figure 6:
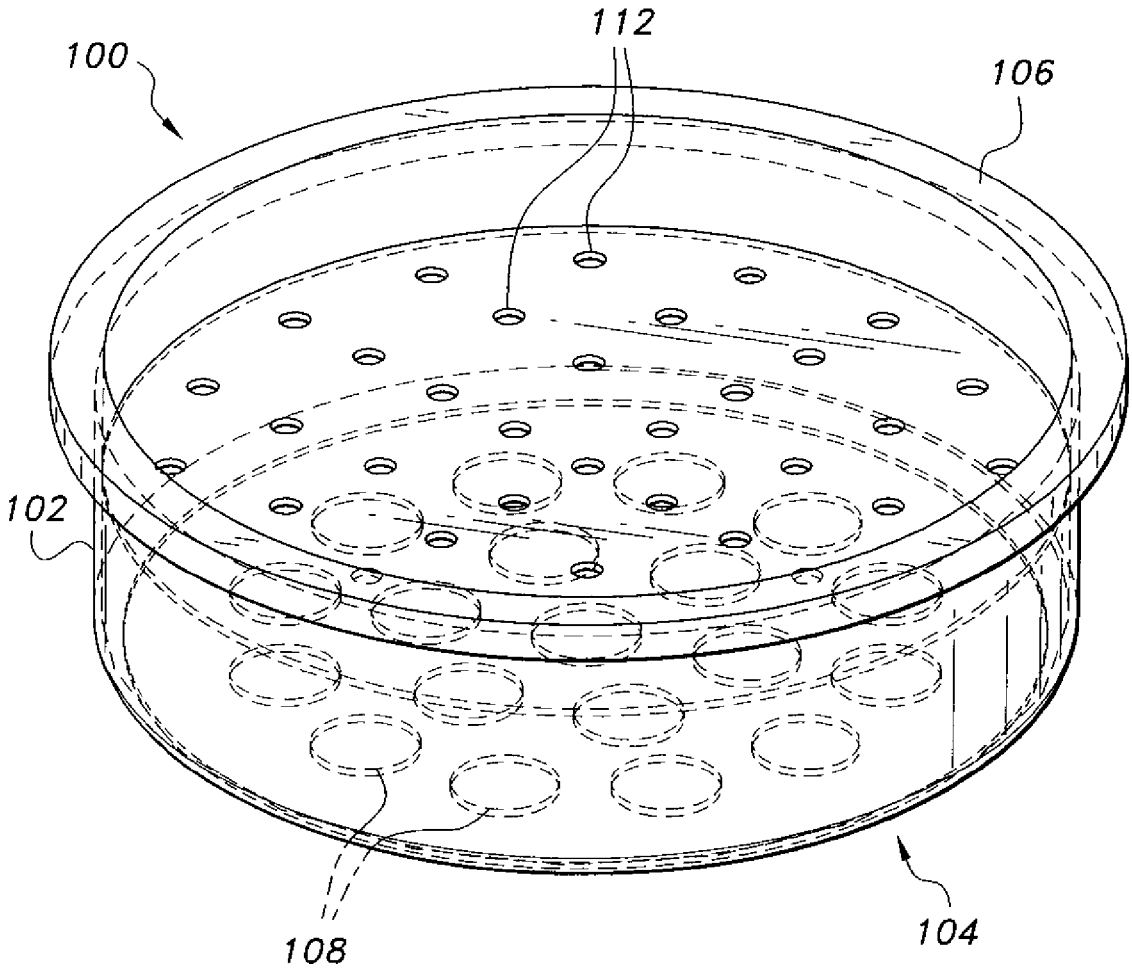
FIG. 6 is a perspective view of an alternative embodiment of the percussion resonance system of FIG. 5.
Figure 7:
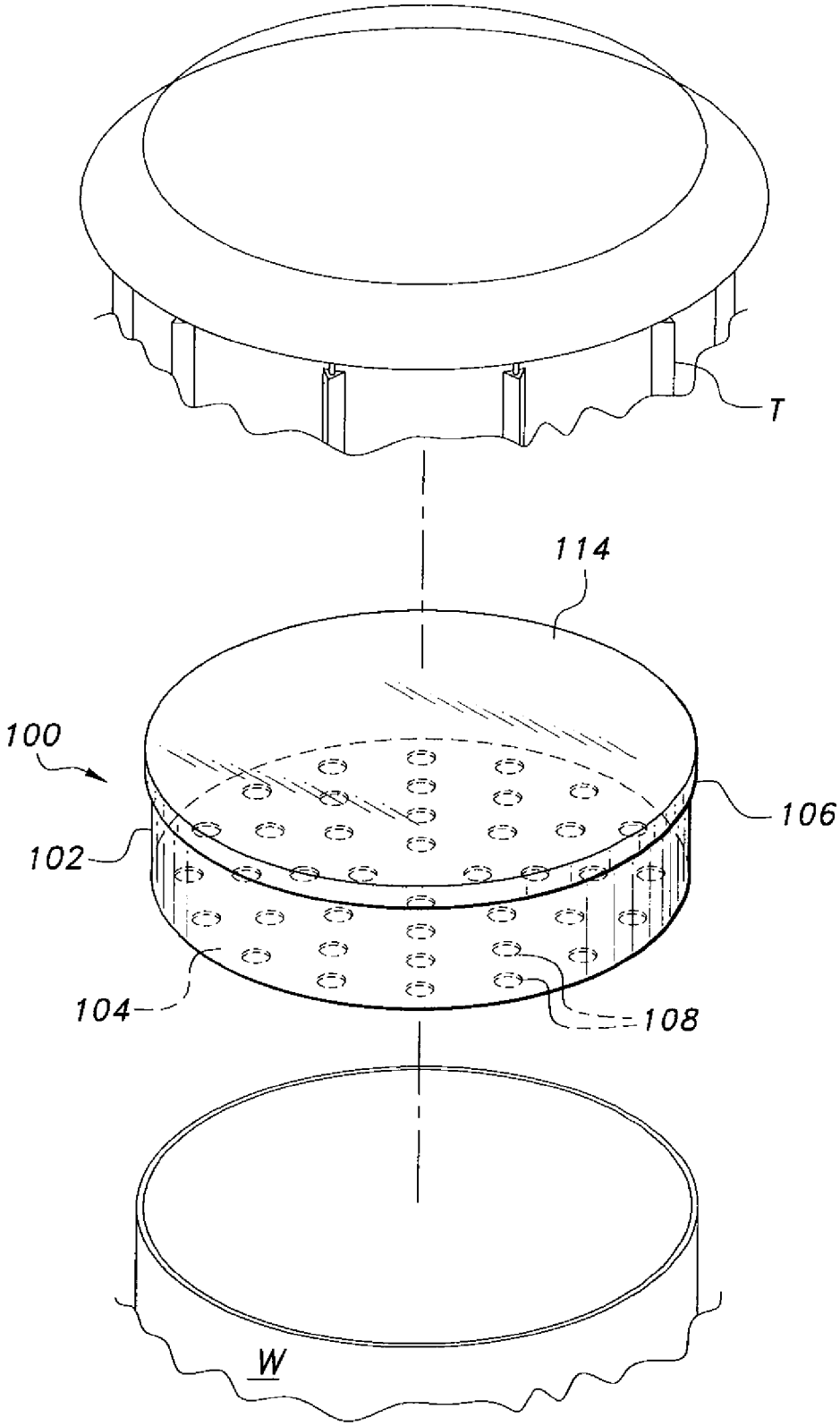
FIG. 7 is a perspective view of another alternative embodiment of the percussion resonance system of FIG. 5.

Preferably, the insert 100 has an annular lip 106 formed about the upper end of the substantially cylindrical sidewall 102, with the annular lip 106 being adapted for positioning on the upper end of the percussion instrument. The batter head B of the percussion instrument can then be mounted on the top surface of the annular lip 106 in a conventional manner, or, as shown in FIG. 7, the insert 100 may be provided with a batter head 114 already secured to the lip 106. As a further alternative, shown in FIG. 6, a secondary wall 110 may be positioned substantially parallel to the lower wall 104, with the secondary wall 110 being positioned between the lower wall 104 and the open upper end and having a plurality of secondary apertures 112 formed therethrough. As shown, apertures 112 and 108 may have differing sizes. As in the previous embodiments, the number, orientation, contouring and dimensions of the apertures may be varied, dependent upon the particular acoustic characteristics desired by the drummer.

Figure 8:
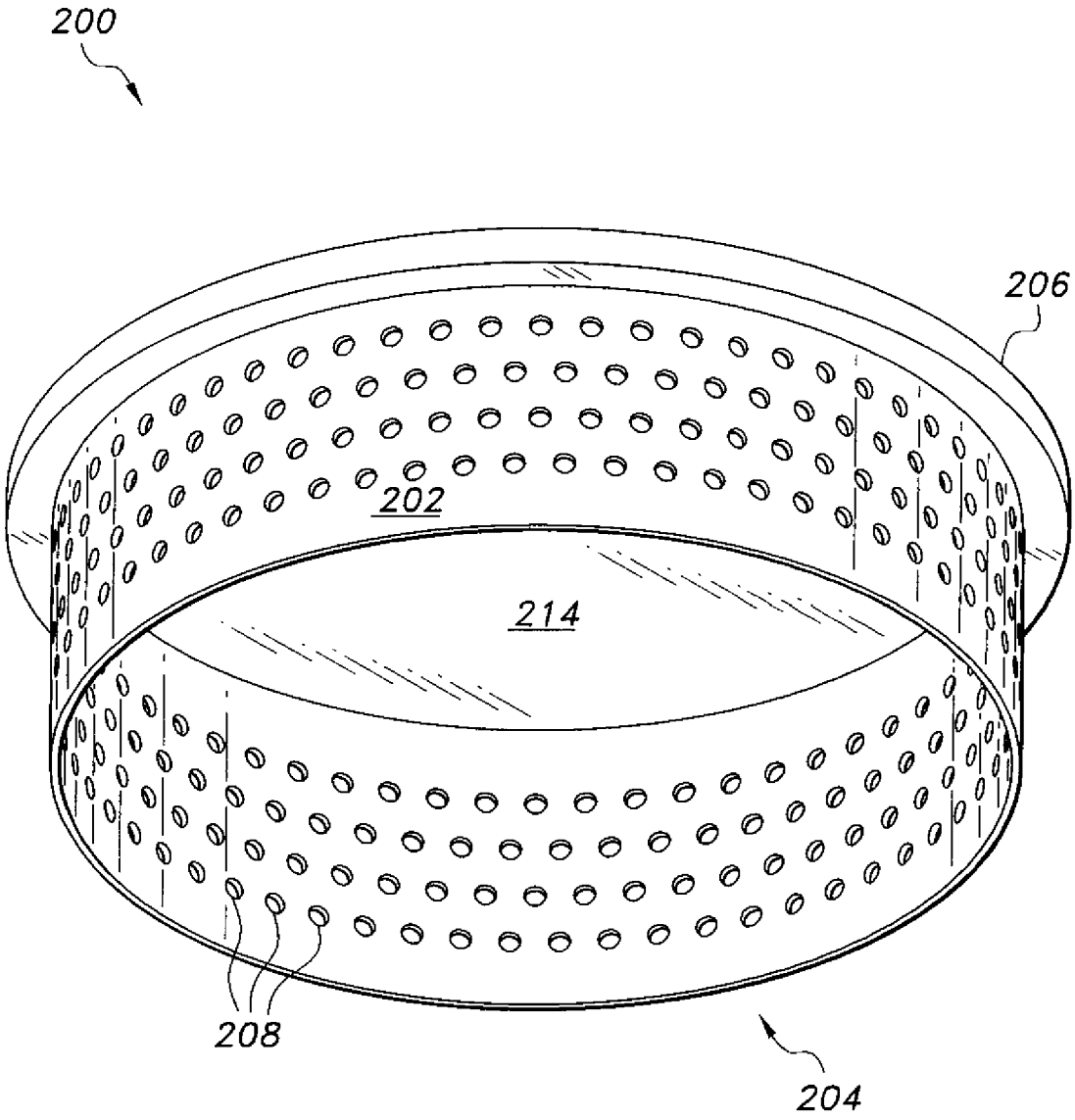
FIG. 8 is a perspective view of another alternative embodiment of the percussion resonance system according to the present invention.

In the alternative embodiment of FIG. 8, an insert 200 includes a substantially cylindrical sidewall 202, but with an open lower end 204, as opposed to the lower wall 104 of the previous embodiment. Insert 200 includes an annular lip 206 with a batter head 214 secured thereto. A plurality of apertures 208 are formed through the cylindrical sidewall 202, as shown.

Figure 11:
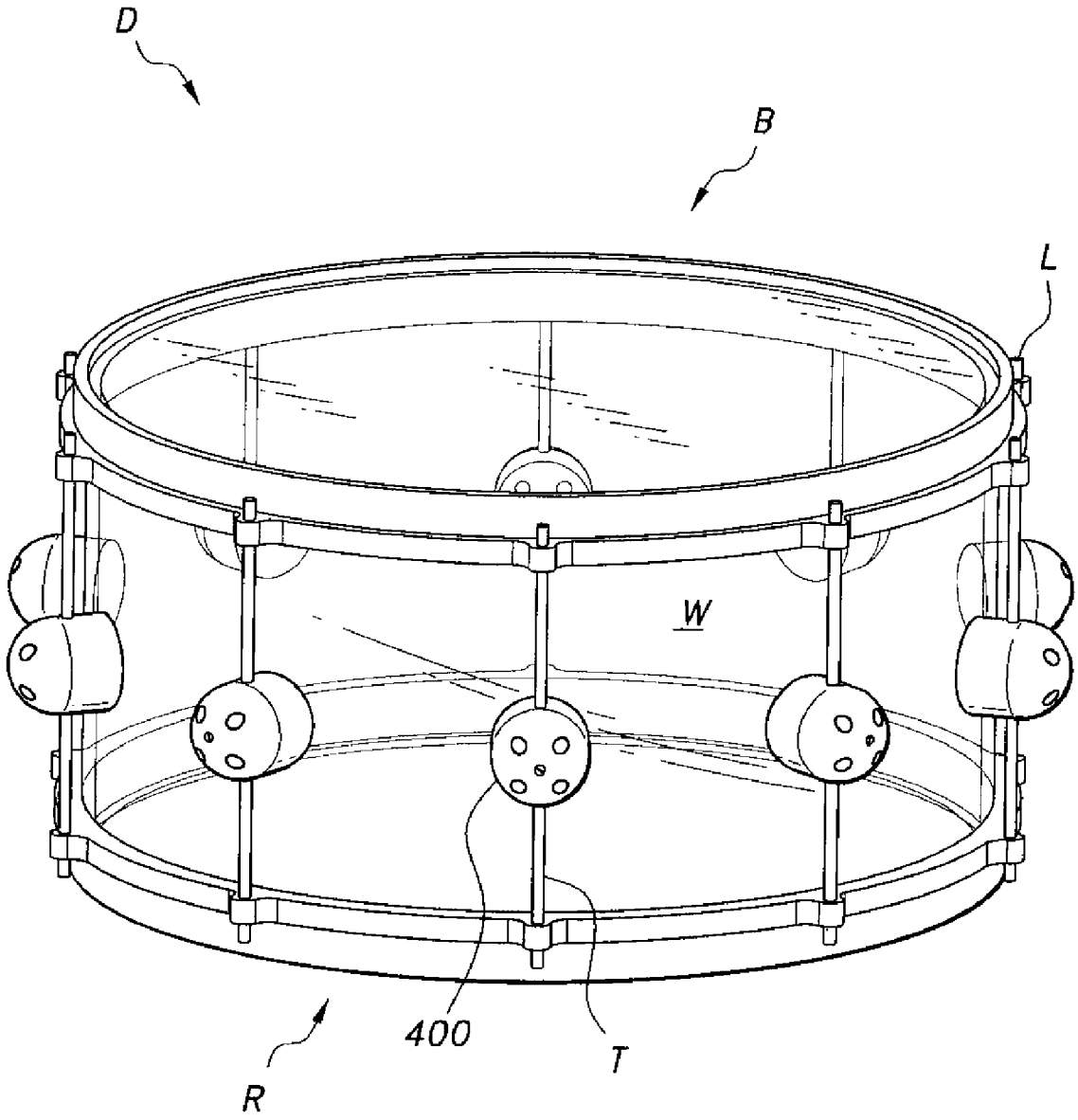
FIG. 11 is a perspective view of another alternative embodiment of the percussion resonance system according to the present invention.
Figure 12:
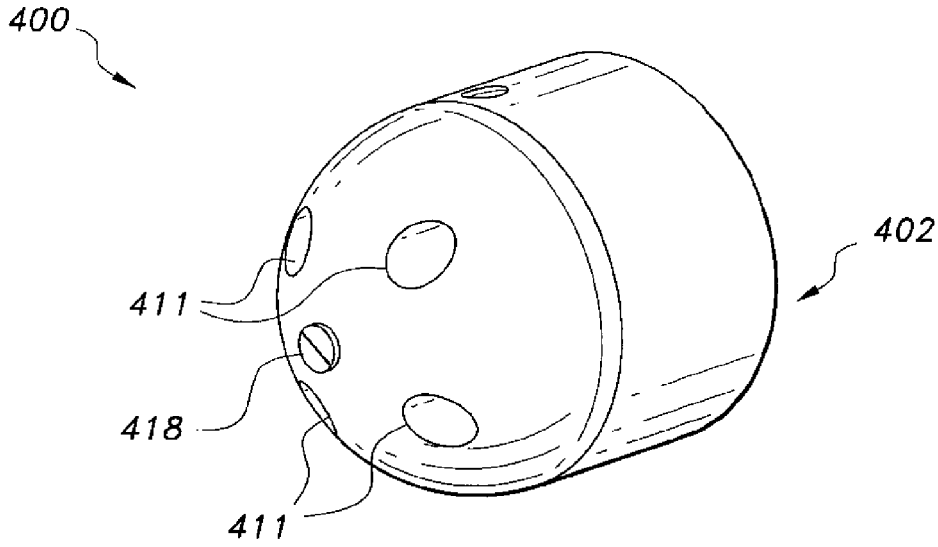
FIG. 12 is a perspective view of a resonating member of the percussion resonance system of FIG. 11.

In a further alternative embodiment, the percussion resonance system illustrated in FIG. 11 includes a substantially cylindrical sidewall W having opposed upper and lower open ends, as in the above, with a batter head B covering the upper end of the substantially cylindrical sidewall W, and a resonant head R covering the lower end of the substantially cylindrical sidewall. As described above, the resonant head R and batter head B are held to the wall W, and tensioned, by tensioning rods T and adjustable lugs L. At least one resonating member 400 is secured to the substantially cylindrical sidewall W, with the at least one resonating member having opposed open and closed ends 402, 404, respectively, and at least one sidewall 408 (as best shown in FIG. 12). A plurality of apertures 406 are formed through the closed end 404.

Figure 13:
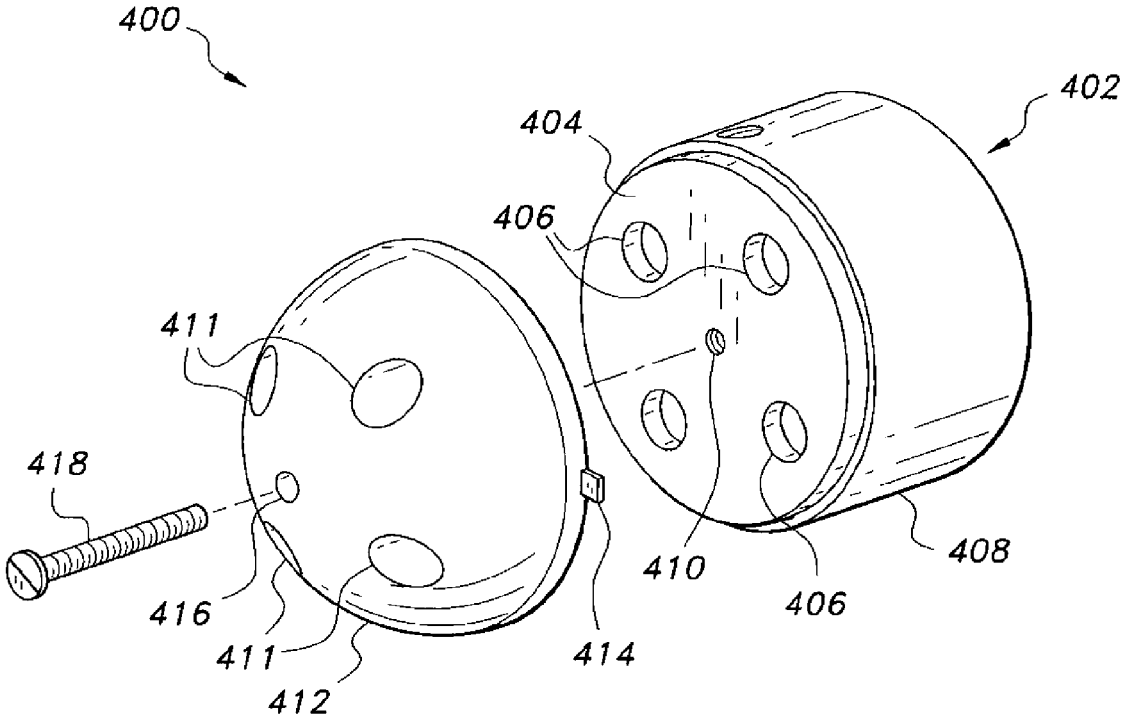
FIG. 13 is an exploded, perspective view of an alternative embodiment of the resonating member of FIG. 11.
Figure 14:
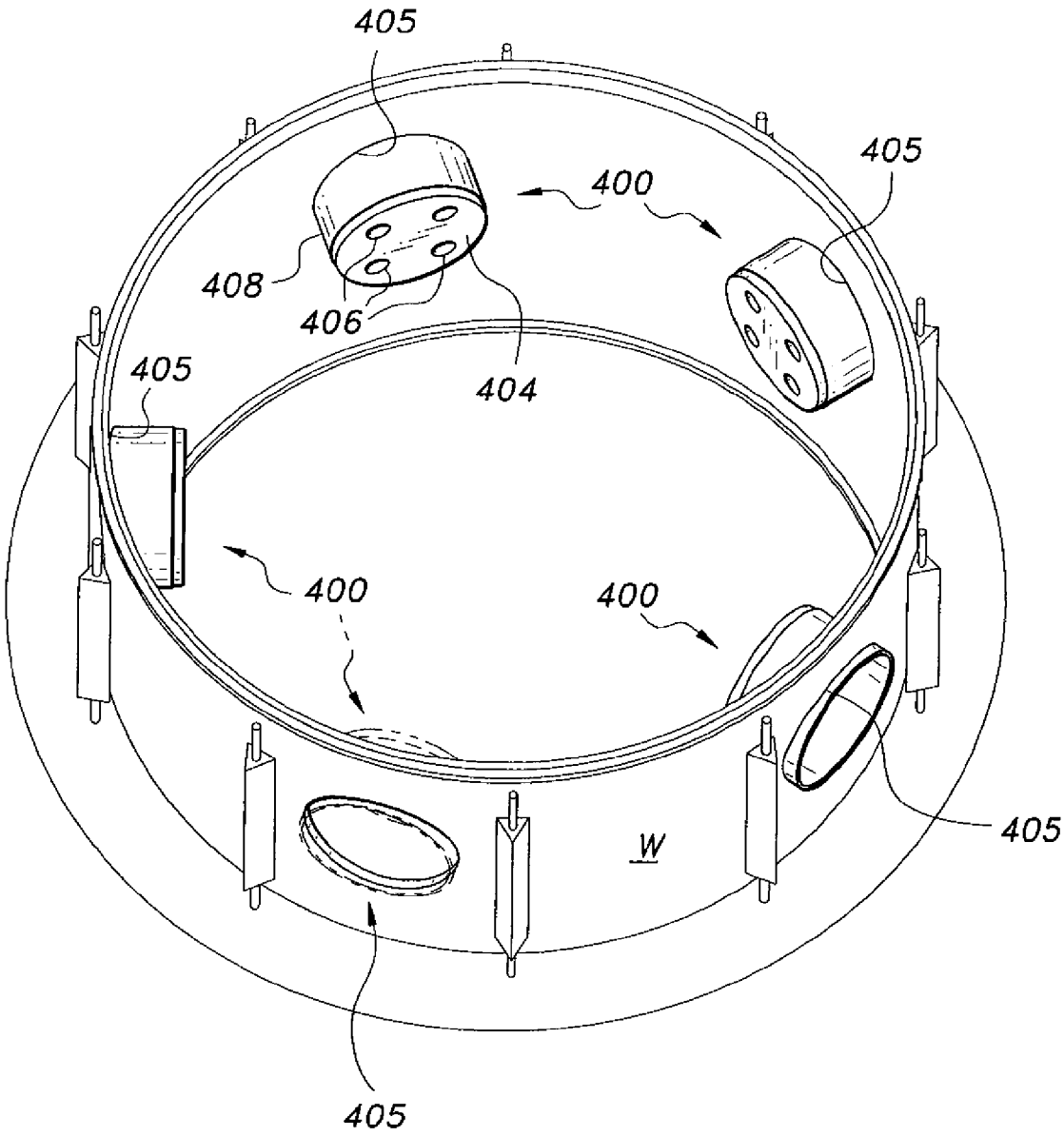
FIG. 14 is an environmental, perspective view of an alternative embodiment of the percussion resonance system of FIG. 11.
Figure 21:
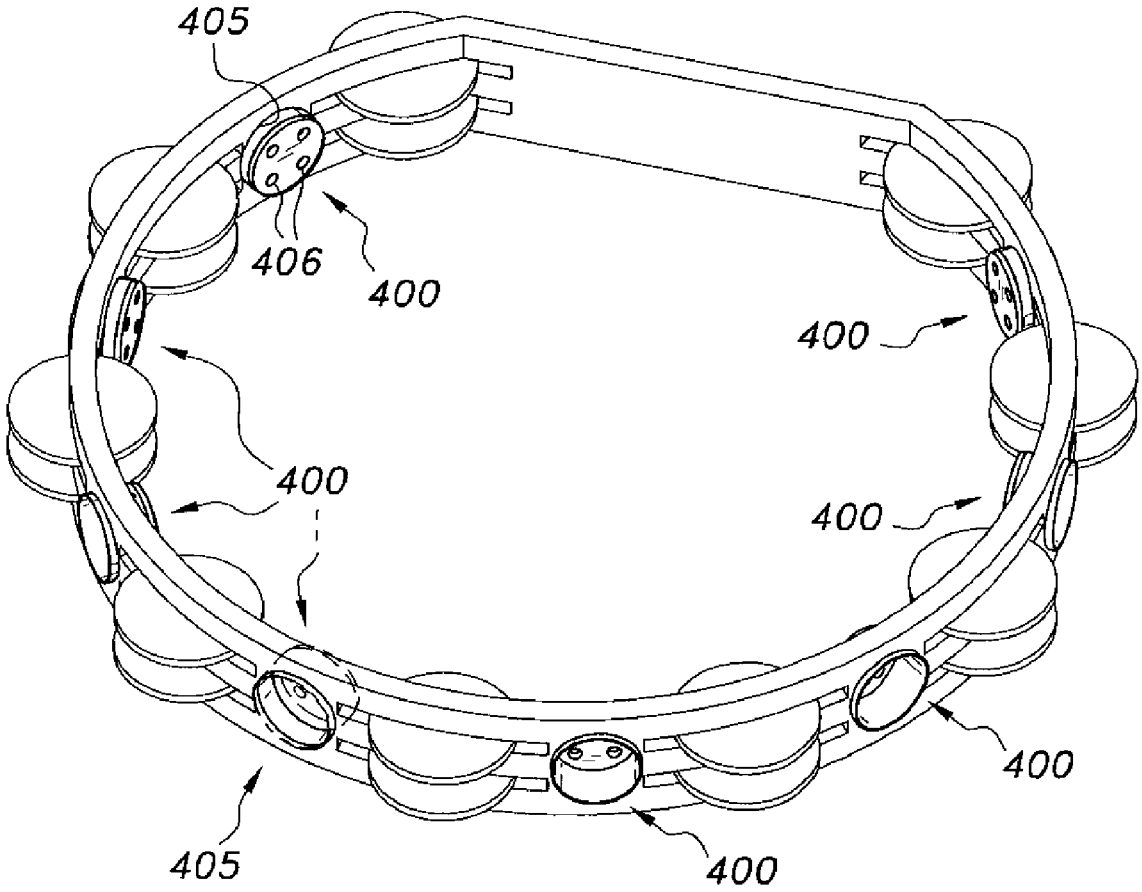
FIG. 21 is a perspective view of yet another alternative embodiment of the percussion resonance system according to the present invention.

The substantially cylindrical sidewall W of the percussion instrument D preferably has at least one opening formed therethrough, with the open end 402 of the at least one resonating member 400 being mounted about and covering the at least one opening. The at least one resonating member 400 may be secured to an inner surface of the substantially cylindrical sidewall W, as shown in FIG. 14, or to an outer surface thereof, as shown in FIG. 11. If secured to the outer surface, the at least one resonating member 400 preferably further includes a cover 412 rotatably secured to the closed end 404, as shown in FIG. 13. Any suitable rotatable attachment, such as exemplary screw 418, which passes through openings 416, 410, may be utilized. The cover 412 has a plurality of apertures 411 formed therethrough, corresponding to the plurality of apertures 406 formed through the closed end 404, such that the user may selectively rotate the cover 412 to selectively cover the plurality of apertures 406 formed through the closed end 404. A tab 414 may be formed on cover 412, allowing the user toe easily grip and rotate the cover 412. Preferably, the at least one sidewall 408 of the at least one resonating member 400 has a substantially cylindrical contour, as shown. In the embodiment of FIG. 14, it should be understood that at least one port 405 is formed through the sidewall W, and that resonating member 400 covers the port 405, as shown. Thus, the port is open in the sidewall, and is covered with a "stopper" 404, which could be formed as a solid piece or a membrane, having apertures 406 formed therethrough. FIG. 21 illustrates a similar resonating member being applied to a tambourine, to show applicability to a variety of percussion instruments.

Figure 15:
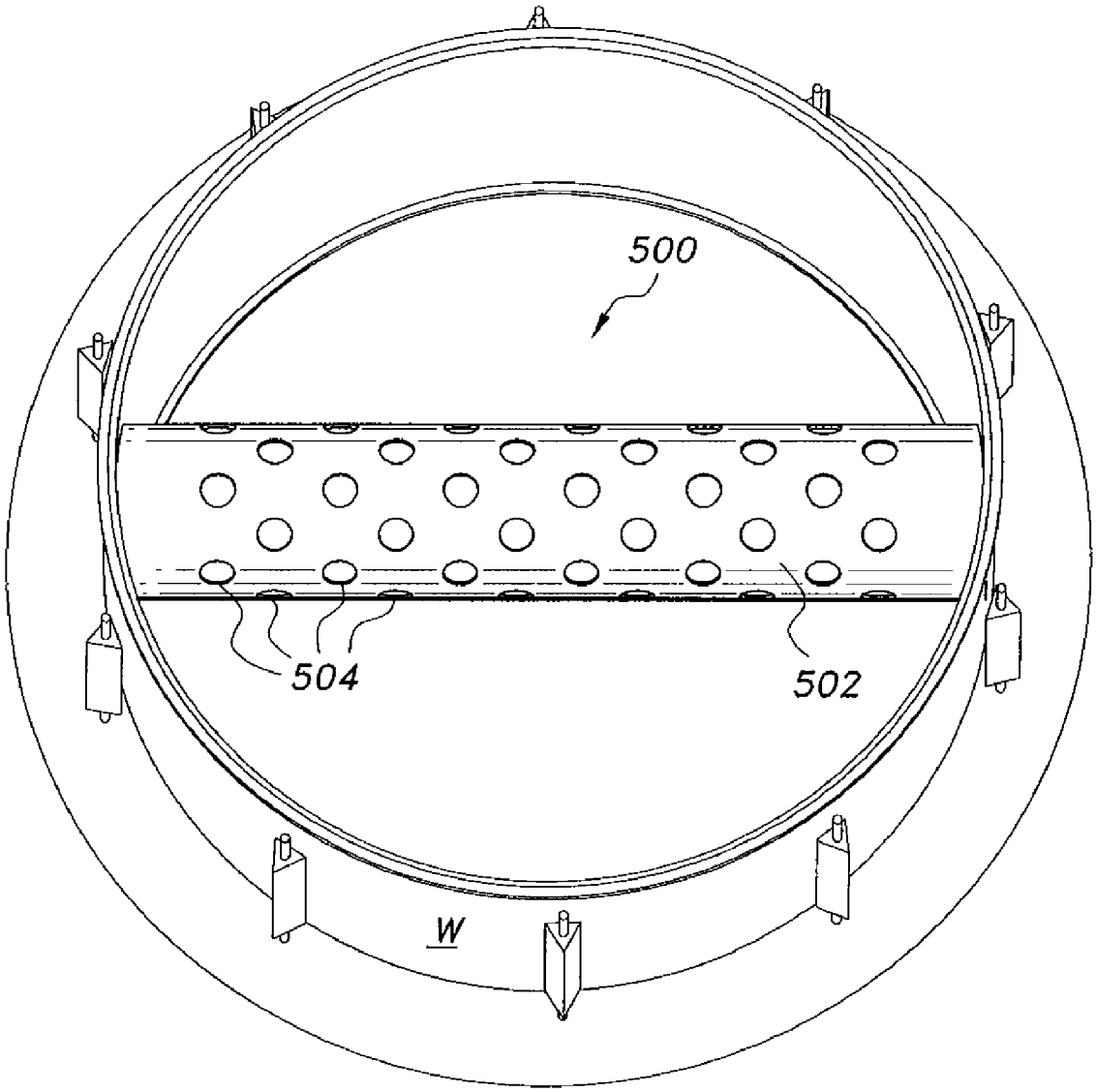
FIG. 15 is an environmental, perspective view of an alternative embodiment of the percussion resonance system of FIG. 11.
Figure 16:
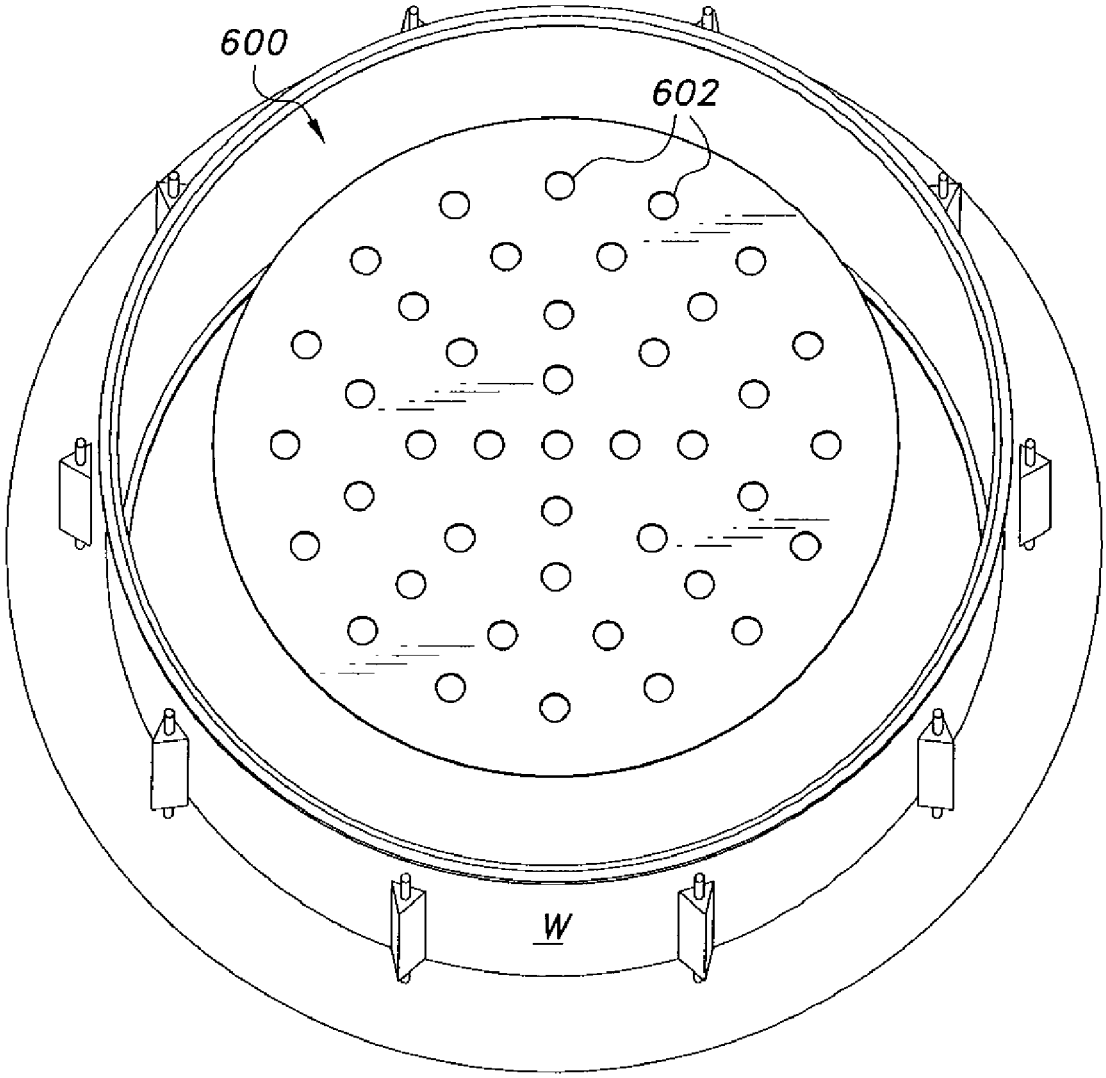
FIG. 16 is an environmental, perspective view of an alternative embodiment of the percussion resonance system of FIG. 11.

In a further alternative embodiment, the percussion resonance system includes a substantially cylindrical sidewall W having opposed upper and lower open ends, a batter head B covering the upper end of the substantially cylindrical sidewall W, and a resonant head R covering the lower end of the substantially cylindrical sidewall, as in the conventional percussion instrument D described above. The percussion resonance system further includes at least one resonating member secured to an inner surface of the substantially cylindrical sidewall W, with the at least one resonating member having at least one sidewall, with a plurality of apertures being formed through the at least one sidewall. As shown in FIG. 16, the resonating member may be in the form of a plate 600 having apertures 602 formed therethrough, with the plate 600 at least partially extending across the interior of the drum wall W. Alternatively, as shown in FIG. 15, the resonating member may be in the form of a hollow cylinder 500 having a cylindrical sidewall 502, with a plurality of apertures 504 extending across the interior of the drum D. The cylinder 500 may extend diametrically across the interior of drum D, or may be positioned away from a diameter of the drum D.

It should be understood that the above embodiments may be used in combination with electronic pickups and electronic percussion instruments, such as MIDI drums, for example, with the differing embodiments of inserts being used as at least partial structure or supports for the electronics associated therewith.

Figure 20:
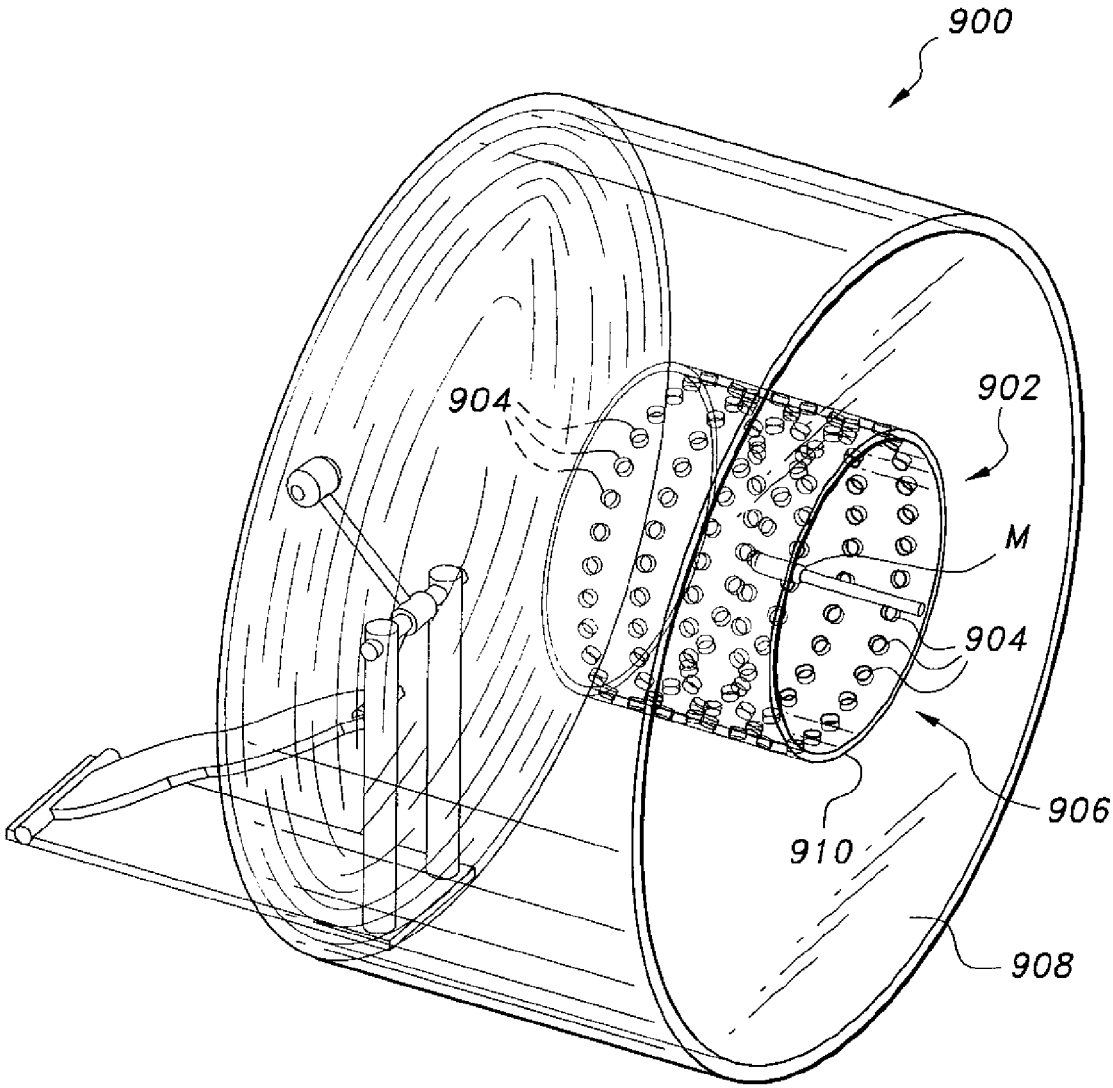
FIG. 20 is a perspective view of yet another alternative embodiment of the percussion resonance system according to the present invention.

In the further alternative embodiment of FIG. 20, drum 900 is provided with a head 908 having a central opening 910 formed therethrough. Such openings and heads are known in the art for the purposes of receiving microphones, such as exemplary microphone M, and other electronic pickups and equipment. In this embodiment, a resonant member 902, having an open end 906, is received within the drum, adjacent the head 908. As in the previous embodiments, the resonant member 902 preferably forms a cylindrical shell, having a plurality of apertures 904 formed through the cylindrical sidewall thereof.

Figure 18A:
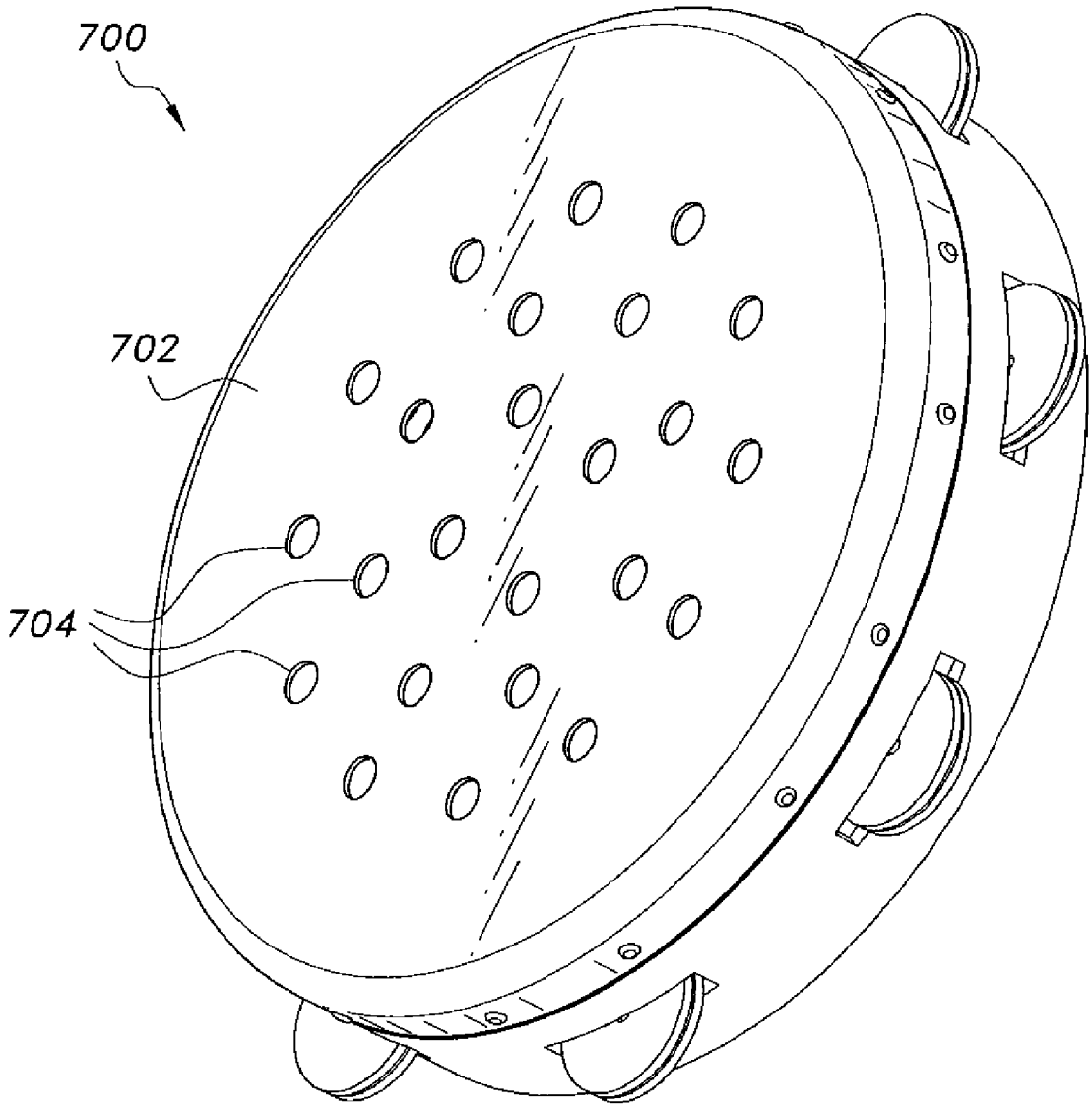
FIG. 18A is a perspective view of another alternative embodiment of the percussion resonance system according to the present invention.
Figure 18B:
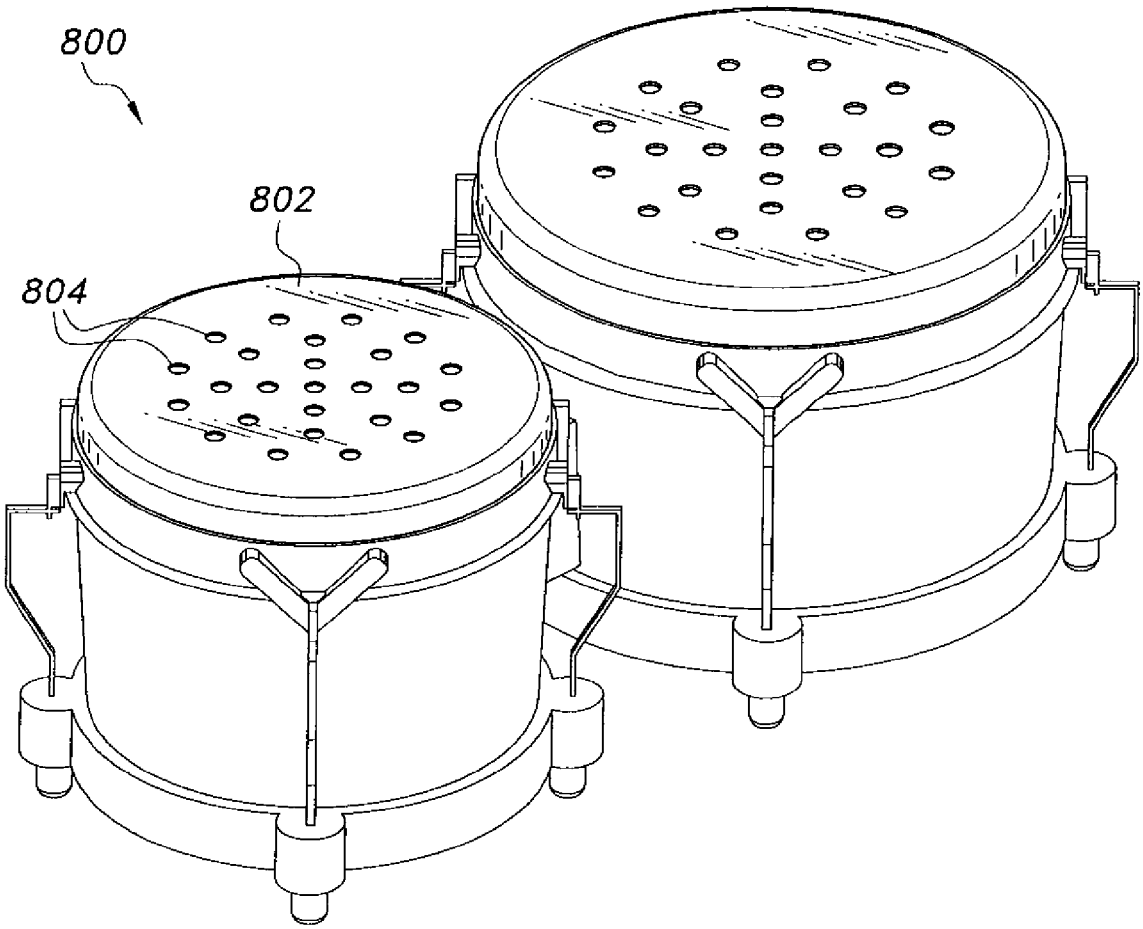
FIG. 18B is a perspective view of another alternative embodiment of the percussion resonance system according to the present invention.

Further, it should be understood that the embodiments described above may be applied to any suitable type of percussion instrument, and that the percussion instruments illustrated in the Figures are shown for exemplary purposes only. For example, FIG. 18A illustrates a conventional tambourine 700 having a batter head 702 with apertures 704 formed therethrough, similar to that shown in FIG. 1. Similarly, FIG. 18B illustrates a conventional bongo drum 800 having a batter head 802 with similar apertures 804 formed therethrough. Each of instruments 700, 800 represent percussion instruments which do not include tensioning means, such as those shown on drum D, and which are sized and shaped to produce distinctive acoustic effects. The formation of apertures 704, 804, however, may be used similarly to that described above with reference to other conventional drums and the like. It should be understood that any of the above-described embodiments may be applied to drums 700, 800. The above-described embodiments may be applied to any suitable percussion instrument, such as, for example, tambourines, tampanis, snare drums, bass drums, etc.

Figure 22:
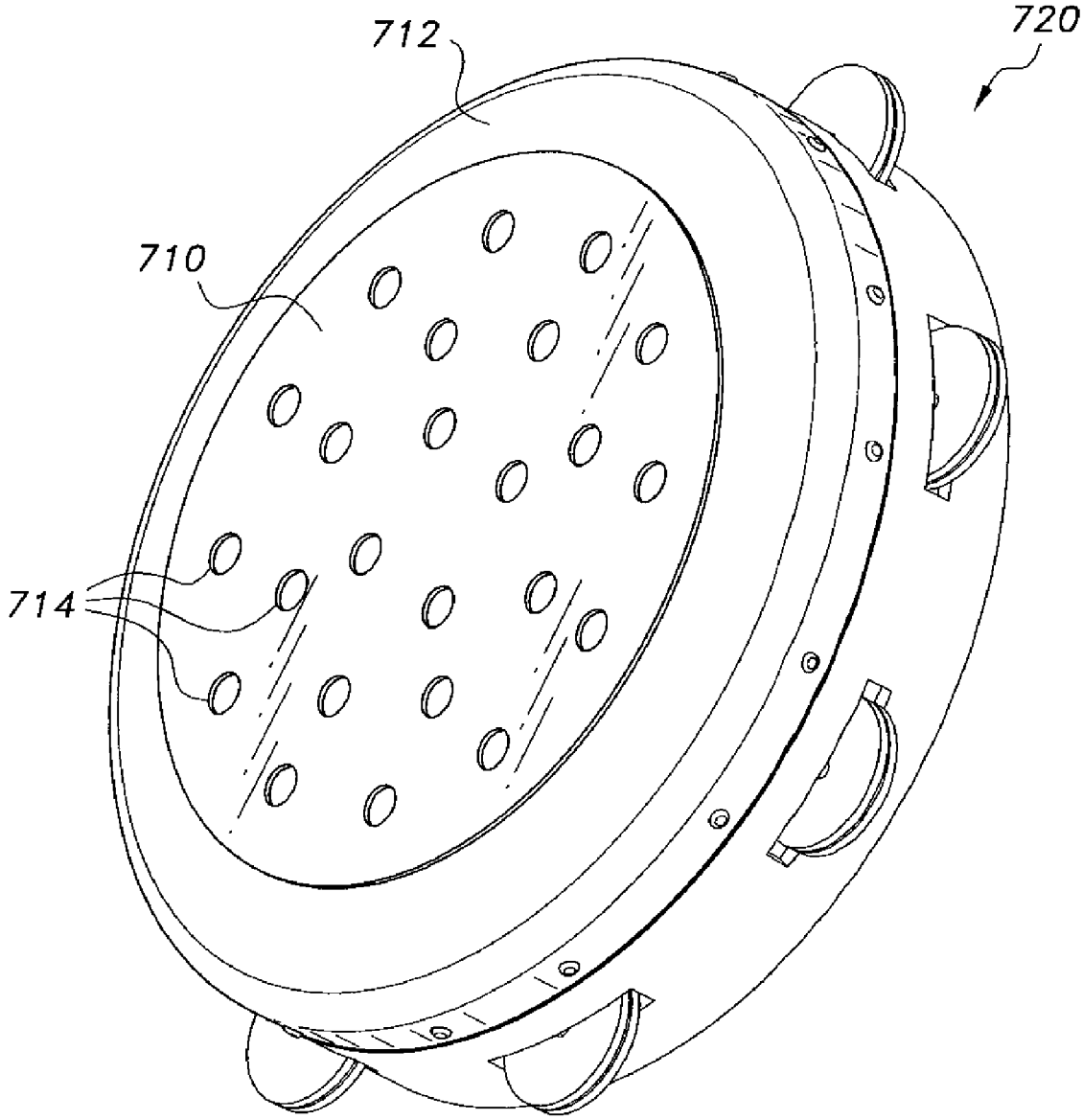
FIG. 22 is a perspective view of yet another alternative embodiment of the percussion resonance system according to the present invention.
Figure 23:
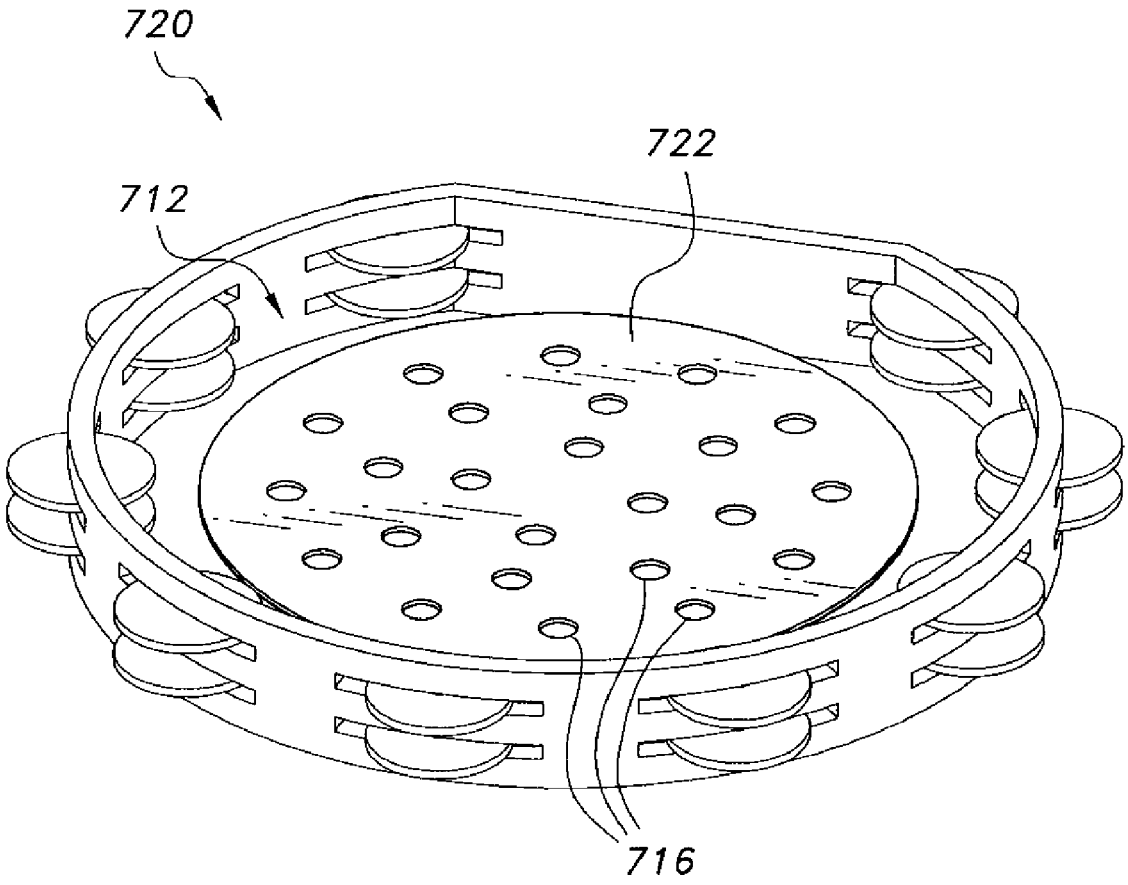
FIG. 23 is a perspective view of yet another alternative embodiment of the percussion resonance system according to the present invention.

FIG. 22 illustrates a tambourine 720, similar in structure to that described above, but having a conventional, solid head 712, with an additional member 710 mounted thereon. Additional member or membrane 710 has apertures 714 formed therethrough. In the embodiment of FIG. 23, there is a recessed, interstitial membrane 722, having apertures 716, mounted to the underside of solid head 712.

It is to be understood that the present invention is not limited to the embodiments described above, but encompasses any and all embodiments within the scope of the following claims.

I claim:

1. A percussion resonance system, comprising an insert for a percussion instrument, the insert including a substantially cylindrical sidewall defining an open upper end, a substantially continuous annular lip formed about the upper end of the sidewall and extending outwardly and downwardly therefrom, and a lower wall, the lower wall having a plurality of apertures formed therethrough, whereby the insert is sized and contoured to be received within the percussion instrument and be positioned beneath an open upper end thereof with the annular lip positioned on the upper end of the instrument.

2. The percussion resonance system as recited in claim 1, wherein said insert further has an annular lip formed about the upper end of the substantially cylindrical sidewall, the annular lip being adapted for positioning on the upper end of the percussion instrument.

3. The percussion resonance system as recited in claim 2, wherein said insert further comprises a secondary wall positioned substantially parallel to the lower wall, the secondary wall being positioned between the lower wall and the open upper end and having a plurality of secondary apertures formed therethrough.

4. The percussion resonance system as recited in claim 3, wherein said insert further comprises a batter head secured to the upper end of the insert.

5. A percussion resonance system, comprising:

a substantially cylindrical sidewall having opposed upper and lower open ends;

a batter head covering the upper end of the substantially cylindrical sidewall, and a resonant head covering the lower end of the substantially cylindrical sidewall; and at least one resonating member secured to the substantially cylindrical sidewall, said at least one resonating member having opposed open and closed ends and at least one sidewall, a plurality of apertures being formed through the closed end thereof.

6. The percussion resonance system as recited in claim 5, wherein the substantially cylindrical sidewall has at least one opening formed therethrough, the open end of the at least one resonating member being mounted about and covering the at least one opening.

7. The percussion resonance system as recited in claim 6, wherein the at least one resonating member is secured to an inner surface of the substantially cylindrical sidewall.

8. The percussion resonance system as recited in claim 6, wherein the at least one resonating member is secured to an outer surface of the substantially cylindrical sidewall.

9. The percussion resonance system as recited in claim 8, further comprising a cover rotatably secured to the closed end of the at least one resonating member, the cover having a plurality of apertures being formed therethrough corresponding to the plurality of apertures formed through the closed end, whereby the user may selectively rotate the cover to selectively cover the plurality of apertures formed through the closed end.

10. The percussion resonance system as recited in claim 9, wherein the at least one sidewall of the at least one resonating member has a substantially cylindrical contour.

11. A percussion resonance system, comprising:

a substantially cylindrical sidewall having opposed upper and lower open ends;

a batter head covering the upper end of the substantially cylindrical sidewall, and a resonant head covering the lower end of the substantially cylindrical sidewall; and at least one resonating member secured to an inner surface of the substantially cylindrical sidewall, said at least one resonating member having at least one sidewall enclosing a volume except for a plurality of apertures being formed through the at least one sidewall and into the volume.

12. The percussion resonance system as recited in claim 11, wherein the at least one sidewall of the at least one resonating member has a substantially planar contour.

13. The percussion resonance system as recited in claim 11, wherein the at least one sidewall of the at least one resonating member has a substantially cylindrical contour.

14. The percussion resonance system as recited in claim 13, wherein the at least one resonating member joins a pair of diametrically opposed points on the inner surface of the at least one sidewall.

* * * * *